US007004000B2

(12) United States Patent
Campo et al.

(10) Patent No.: US 7,004,000 B2
(45) Date of Patent: Feb. 28, 2006

(54) DEFORMATION OF THIN WALLED BODIES

(75) Inventors: Santiago Garcia Campo, Llodio (ES); Juan Salz Goiria, Llodia (ES)

(73) Assignee: Envases (UK) Limited, Port Talbot (GB)

( * ) Notice: Subject to any disclaimer, the term of this patent is extended or adjusted under 35 U.S.C. 154(b) by 0 days.

(21) Appl. No.: 10/851,922

(22) Filed: May 21, 2004

(65) Prior Publication Data

US 2005/0056065 A1 Mar. 17, 2005

Related U.S. Application Data

(63) Continuation of application No. 10/182,643, filed as application No. PCT/GB01/00526 on Feb. 9, 2001.

(30) Foreign Application Priority Data

Feb. 10, 2000 (GB) ..... 0003033
Oct. 27, 2000 (GB) ..... 0026325

(51) Int. Cl.
*B21D 11/10* (2006.01)

(52) U.S. Cl. ..... 72/94; 72/17.3; 72/379.4; 72/405.03; 72/421; 72/422; 72/715

(58) Field of Classification Search ..... 72/15.2, 72/15.3, 17.3, 94, 105, 421, 379.4, 296, 405.03, 72/420, 422, 715; 101/4
See application file for complete search history.

(56) References Cited

U.S. PATENT DOCUMENTS

| | | | | |
|---|---|---|---|---|
| 2,966,872 A | | 1/1961 | Schmocker | 133/44 |
| 3,247,548 A | | 4/1966 | Fields et al. | 18/34 |
| 3,628,451 A | * | 12/1971 | McClellan et al. | 101/4 |
| 3,687,098 A | | 8/1972 | Maytag | 113/120 |
| 3,688,537 A | | 9/1972 | Schnieder | 72/74 |
| 3,967,488 A | | 7/1976 | Hasselbeck et al. | 72/355 |
| 4,070,888 A | | 1/1978 | Gombas | 72/91 |
| 4,120,190 A | | 10/1978 | Schlau et al. | 72/458 |
| 4,341,103 A | * | 7/1982 | Escallon et al. | 72/70 |
| 4,487,048 A | | 12/1984 | Frei | 72/94 |
| 4,625,541 A | | 12/1986 | Jones et al. | 72/421 |
| 4,723,430 A | | 2/1988 | Hahn | 72/54 |
| 5,341,667 A | | 8/1994 | Lee, Jr. | 72/379 |
| 5,467,628 A | | 11/1995 | Bowlin et al. | 72/126 |
| 5,727,414 A | | 3/1998 | Halasz et al. | 72/348 |
| 5,761,942 A | | 6/1998 | Johnson et al. | 72/94 |
| 5,799,525 A | | 9/1998 | Johnson et al. | 72/105 |
| 5,893,286 A | | 4/1999 | Johnson et al. | 72/17.3 |
| 5,916,317 A | | 6/1999 | Willoughby et al. | 72/61 |
| 5,941,109 A | * | 8/1999 | Johnson et al. | 72/17.3 |
| 6,009,733 A | * | 1/2000 | Cheers et al. | 72/17.3 |
| 6,338,263 B1 | | 1/2002 | Obata et al. | 72/105 |

FOREIGN PATENT DOCUMENTS

| | | |
|---|---|---|
| EP | 1214991 A2 | 12/2001 |
| EP | 1214994 A1 | 12/2001 |

(Continued)

*Primary Examiner*—Ed Tolan
(74) *Attorney, Agent, or Firm*—Gordon & Jacobson, P.C.

(57) ABSTRACT

A thin walled body such as a container is gripped at a holding station and tooling is engaged to deform the wall of the body at a predetermined zone. The predetermined wall zone is co-aligned with the tooling by means of co-ordinated movement of the tooling (typically by means of rotation about a tooling axis) prior to engagement with the wall zone.

19 Claims, 11 Drawing Sheets

FOREIGN PATENT DOCUMENTS

| | | |
|---|---|---|
| GB | 778545 | 7/1957 |
| GB | 1384184 | 2/1975 |
| GB | 1408091 | 10/1975 |
| GB | WO 97/21505 | 11/1996 |
| WO | WO 98/03280 | 7/1997 |

* cited by examiner 1
13a
14
14
12
12
11a
3
4
11b
17
11a
13a
13a
15
13
13
13c
13c
20
20
21
21
11
11
6
22
16
A
B
D
E
9
25

DEFORMATION OF THIN WALLED BODIES

CROSS-REFERENCE TO RELATED APPLICATIONS

The present application is a continuation of U.S. application Ser. No. 10/182,643, filed Sep. 30, 2002 Which is a National stage 371 of PCT/GB01/00526, filed Feb. 9, 2001.

BACKGROUND OF THE INVENTION

1. Field of the Invention

The present invention relates to deformation of generally thin walled bodies, particularly thin walled containers or tube-form bodies which may be of cylindrical or other form.

The invention is particularly suited to embossing of thin walled metallic bodies (particularly aluminium containers) by embossing or the like. More specifically the invention may be used in processes such as registered embossing of thin walled bodies, particularly registered embossing of containers having pre-applied (pre-printed) surface decoration.

2. State of the Art

It is known to be desirable to deform by embossing or the like the external cylindrical walls of metallic containers such as aluminium containers. In particular attempts have been made to emboss the walls of containers at predetermined locations to complement a printed design on the external surface of such a container. In such techniques it is important to coordinate the embossing tooling with the preprinted design on the container wall. Prior art proposals disclose the use of a scanning system to identify the position of the container relative to a datum position and reorientation of the container to conform to the datum position.

Prior art embossing techniques and apparatus are disclosed in, for example, WO-A-9803280, WO-A-9803279, WO-A-9721505 and WO-A-9515227. Commonly in such techniques the container is loaded into an internal tool which acts to support the container and also co-operate with an external tool in order to effect embossing. Such systems have disadvantages, as will become apparent from the following.

An improved technique has now been devised.

SUMMARY OF THE INVENTION

According to a first aspect, the present invention provides a method of deforming a thin walled body, the method comprising:

i) holding the body gripped securely at a holding station;

ii) engaging tooling to deform the wall of the body at a predetermined wall zone, the tooling being provided at a tooling station which is adjacent the holding station during deformation;

wherein the predetermined wall zone is co-aligned with the tooling by means of co-ordinated movement of the tooling prior to deforming engagement with the wall of the body.

According to a further aspect, the invention provides apparatus for deforming a thin walled body, the apparatus including:

i) a holding station for holding the body gripped securely;

ii) a tooling station including tooling to deform the body at a predetermined wall zone of the body, the tooling station being positioned at a location adjacent the holding station during deformation;

iii) determination means for determining the orientation of the cylindrical body relative to a reference (datum) situation;

iv) means for co-ordinated movement to reconfigure the tooling to co-align with the predetermined wall zone prior to deforming engagement of the tooling with the body.

Co-alignment of the tooling and the wall zone of the body is typically required in order to ensure that embossing deformation accurately lines up with pre-printed decoration on the body. In the technique of the present invention, the body is not passed from being supported at a holding station to being supported by the tooling but, by contrast, remains supported at the holding station throughout the deforming process.

Re-configuration of the tooling avoids the requirement for the or each holding or clamping station to have the facility to re-orientate a respective body.

The technique is particularly suited to embossing containers having wall thicknesses (t) in the range 0.25 mm to 0.8 mm (particularly in the range 0.35 mm to 0.6 mm). The technique is applicable to containers of aluminium including alloys, steel, tinplate steel, internally polymer laminated or lacquered metallic containers, or containers of other materials. Typically the containers will be cylindrical and the deformed embossed zone will be co-ordinated with a pre-printed/pre-applied design on the circumferential walls. Typical diameters of containers with which the invention is concerned will be in the range 35 mm to 74 mm although containers of diameters outside this range are also susceptible to the invention.

Beneficially the tooling will be re-configurable by rotation of the tooling about a rotational tooling axis to co-align with the predetermined wall zone.

The determination means preferably dictates the operation of the tooling rotation means to move/rotate the tooling to the datum position. The determination means preferably determines a shortest rotational path (clockwise or anti-clockwise) to the datum position and triggers rotation of the tooling in the appropriate sense.

The length of time available to perform the steps of re-orientation and deformation is relatively short for typical production runs which may process bodies at speeds of up to 200 containers per minute. Re-orientation of the tooling (particularly by rotation of the tooling about an axis) enables the desired re-orientation to be achieved in the limited time available. The facility to re-orientate clockwise or anti-clockwise following sensing of the container orientation and shortest route to the datum position is particularly advantageous in achieving the process duration times required.

According to a further aspect, the invention provides apparatus for use in deforming a wall zone of a thin walled container, the apparatus comprising internal tooling to be positioned internally of the container, and external tooling to be positioned externally of the container, the external and internal tooling co-operating in a forming operation to deform the wall zone of the container, the internal tooling being moveable toward and away from the centreline or axis of the container between a retraction/insertion tooling configuration in which the internal tool can be inserted or retracted from the interior of the container, to a wall engaging configuration for effecting deforming of the wall zone.

Correspondingly a further aspect of the invention provides a method of deforming a thin walled container, the method comprising:

inserting internal tooling into the interior of the container, the internal tooling being in a first, insertion configuration for insertion;

moving the tooling to a second, (preferably expanded) position or configuration closely adjacent or engaging the internal container wall so as to facilitate deformation of a wall zone of the container;

returning the tooling from the second position toward the first tooling configuration thereby to permit retraction of the internal tooling from the container.

Because the internal tooling is movable toward and away from the container wall (preferably toward and away from the axis/centreline of the container), embossed relief features of greater depth/height can be produced. This is because prior art techniques generally use an internal tool which also serves to hold the container during deformation (embossing) and therefore typically only slight clearance between the internal tool diameter and the internal diameter of the container has been the standard practice.

In accordance with the broadest aspect of the invention, the relief pattern for embossing may be carried on cam portions of internal and/or external tools, the eccentric rotation causing the cam portions to matingly emboss the relevant portion of the container wall.

A particular benefit of the present invention is that it enables a greater area of the container wall (greater dimension in the circumferential direction) to be embossed than is possible with prior art techniques where the emboss design would need to be present on a smaller area of the tool. Rotating/cam-form tooling, for example, has the disadvantage of having only a small potential area for design embossing.

Re-configurable, particularly collapsible/expandable internal tooling provides that greater depth/height embossing formations can be provided, the internal tooling being collapsed from engagement with the embossed zone and subsequently retracted axially from the interior of the container.

Embossed feature depth/height dimensions in the range 0.5 mm and above (even 0.6 mm to 1.2 mm and above) are possible which have not been achievable with prior art techniques.

According to a further aspect, the invention provides apparatus for use in deforming the cylindrical wall of a thin walled cylindrical container, the apparatus comprising an internal tooling part to be positioned internally of the container, and an external tooling part to be positioned externally of the container, the external and internal tools co-operating in a forming operation to deform a portion of the cylindrical container wall therebetween; wherein tooling actuation means is provided such that:

(a) the external and internal tools are movable independently of one another to deform the container wall; and/or (b) deforming force applied to the external and internal tools is positioned at force action zones spaced at opposed sides of the zone of the container wall to be deformed.

As described above, the technique of the invention is particularly suited to embossing containers having relatively thick wall thickness dimensions (for example in the range 0.35 mm to 0.8 mm). Such thick walled cans are suitable for containing pressurised aerosol consumable products stored at relatively high pressures. Prior art techniques have not been found to be suitable to successfully emboss such thicker containers, nor to produce the aesthetically pleasing larger dimensioned emboss features as is capable with the present invention (typically in the range 0.3 mm to 1.2 mm depth/height).

The technique has also made it possible to emboss containers (such as seamless monobloc aluminium containers) provided with protective/anti-corrosive internal coatings or layers without damage to the internal coating or layer.

According to a further aspect, the invention therefore provides an embossed container or tube-form product, the product comprising a product side-wall having a thickness substantially in the range 0.25 mm to 0.8 mm and a registered embossed wall zone, the embossed deformation having an emboss form depth/height dimension substantially in the range 0.3 mm to 1.2 mm or above.

Preferred features of the invention are defined in the appended claims and readily apparent from the following description. The various features identified and defined as separate aspects herein are also mutually beneficial and may be beneficially included in combination with one another.

BRIEF DESCRIPTION OF THE DRAWINGS

The invention will now be further described in a specific embodiment, by way of example only, and with reference to the accompanying drawings, in which.

DETAILED DESCRIPTION OF THE PREFERRED

Figure 1:
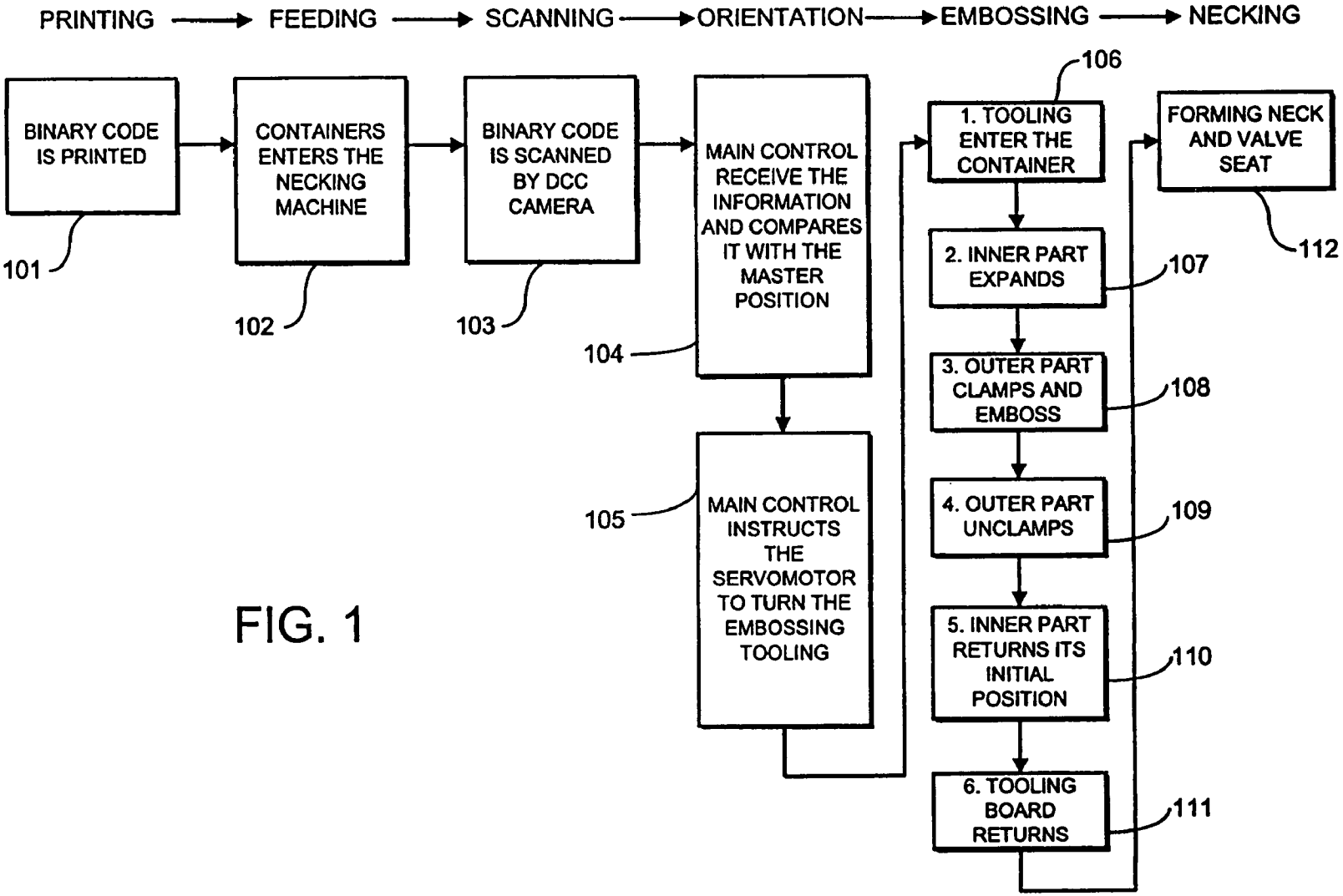
FIG. 1 is a flow diagram of a process according to the invention.

Referring to the drawings the apparatus and technique is directed to plastically deforming (embossing or debossing) the circumferential wall of an aluminium container 1 at a predetermined position relative to a preprinted decorative design on the external container wall. Where the embossing deformation is intended to coincide with the printed decorative design, this is referred to in the art as Registered Embossing.

Figures 16, 16A, 17:
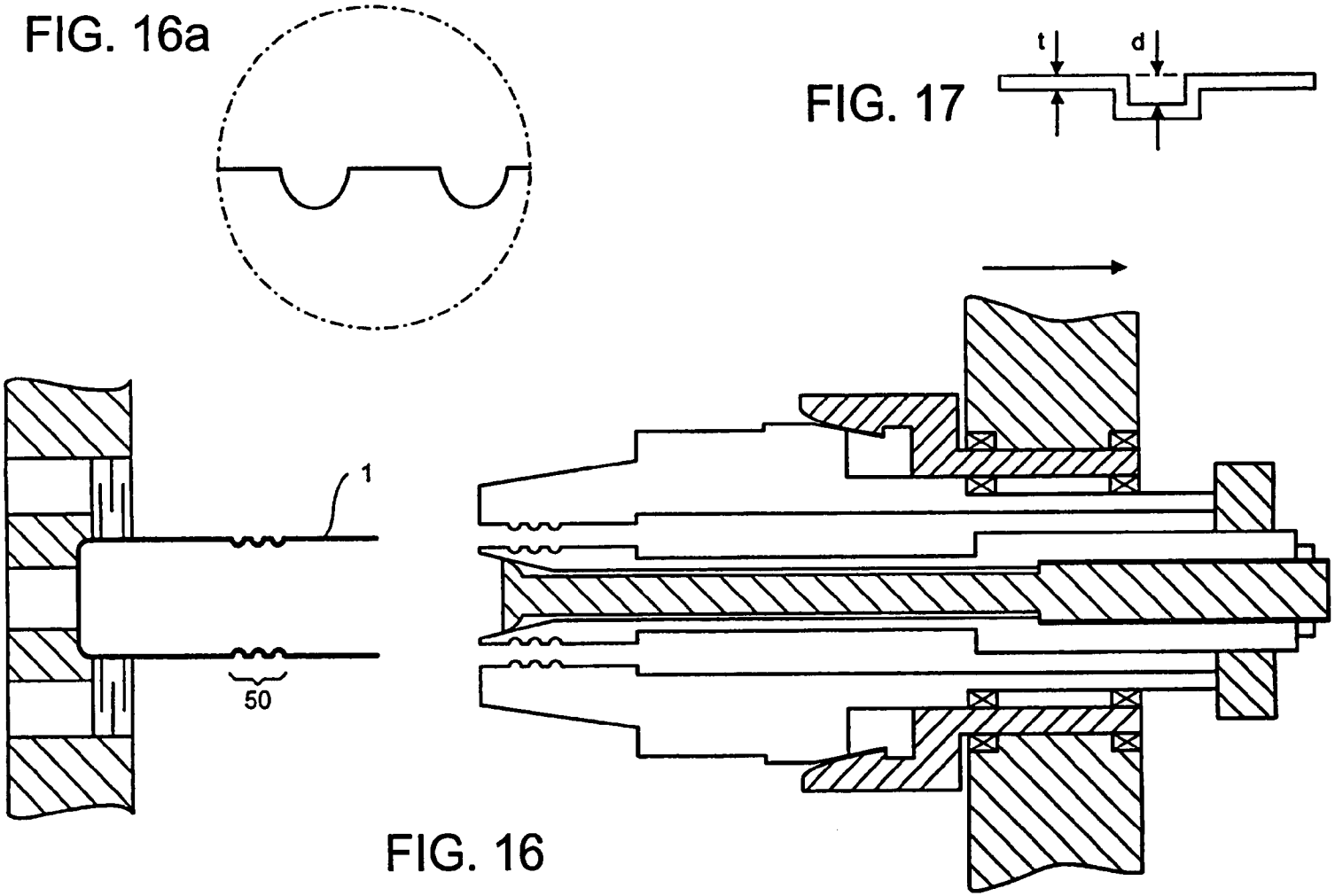
FIG. 17 is a schematic sectional view of an embossed zone of a container wall in accordance with the invention.

In the embodiment shown in the drawings, a design 50 comprising a series of three axially spaced arc grooves is to be embossed at 180 degree opposed locations on the container wall (see FIG. 16*a*). For aesthetic reasons it is important that the location at which the design 50 is embossed is coordinated with the printed design on the container 1 wall. Coordination of the container 1 axial orientation with the tooling to effect deformation is therefore crucial.

Figure 7:
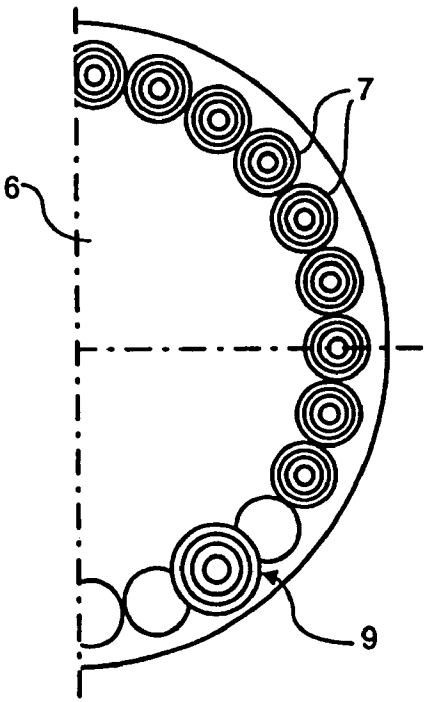
FIGS. 6 and 7 are half plan views of apparatus components of FIG. 5.
Figure 5:
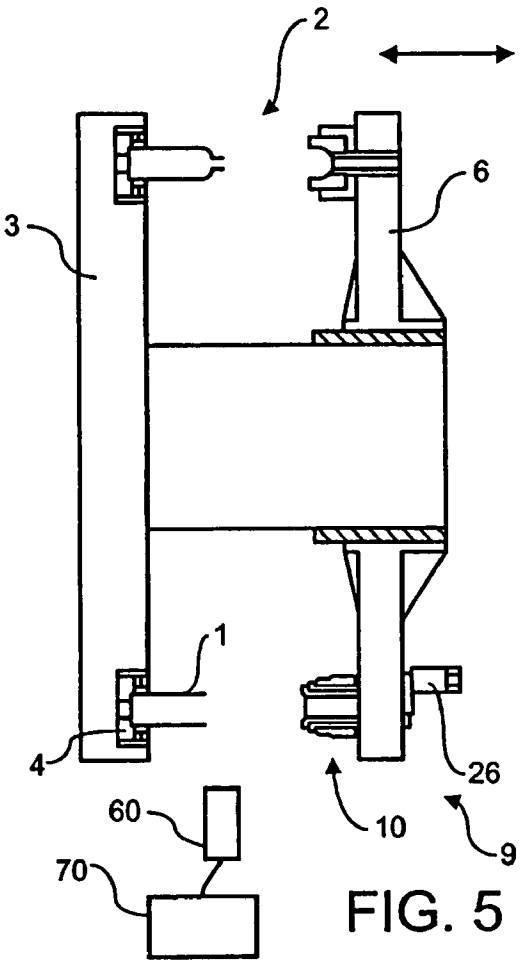
FIG. 5 is a schematic side view of apparatus in accordance with the invention.
Figure 6:
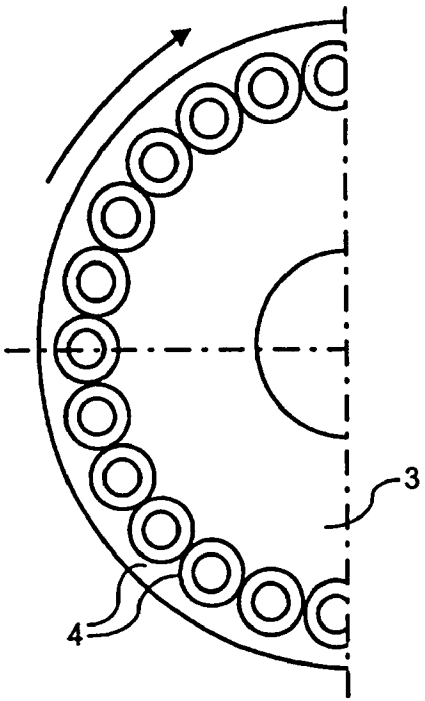
Figure 10:
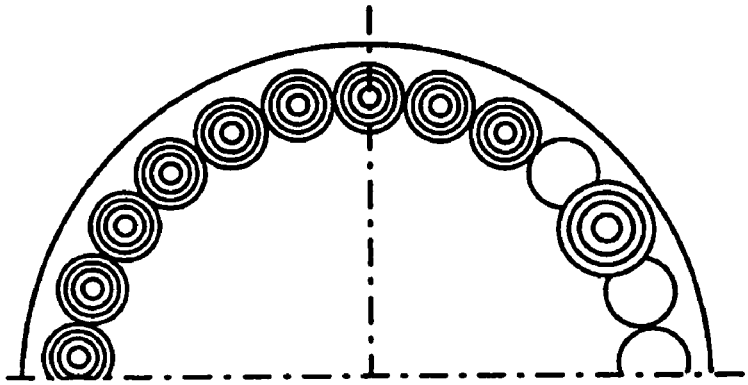
FIGS. 8, 9 and 10 correspond to the views of FIGS. 5, 6 and 7 with components in a different operational orientation.

Referring to FIGS. 5 to 7 the forming apparatus 2 comprises a vertically orientated rotary table 3 operated to rotate (about a horizontal axis) in an indexed fashion to successively rotationally advanced locations. Spaced around the periphery of table 3 are a series of container holding stations comprising clamping chucks 4. Containers are delivered in sequence to the table in random axial orientations, each being received in a respective chuck 4, securely clamped about the container base 5.

Figure 3:
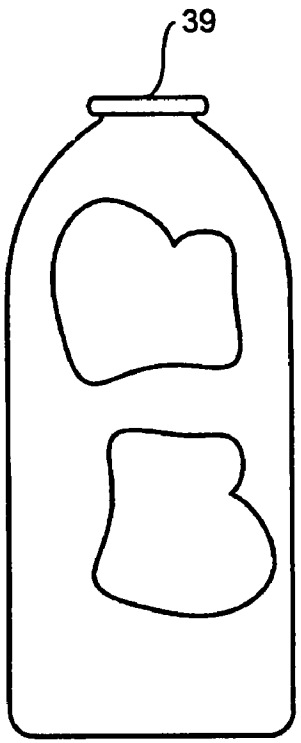
FIG. 3 is a side view of the container of FIG. 2 in a finish formed state.
Figure 2:
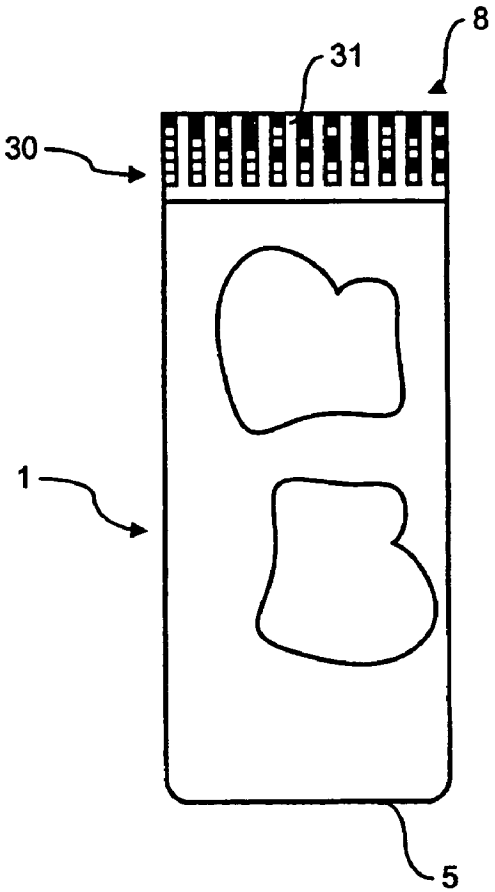
FIG. 2 is a view of a container to be operated upon in accordance with the invention.
Figure 8:
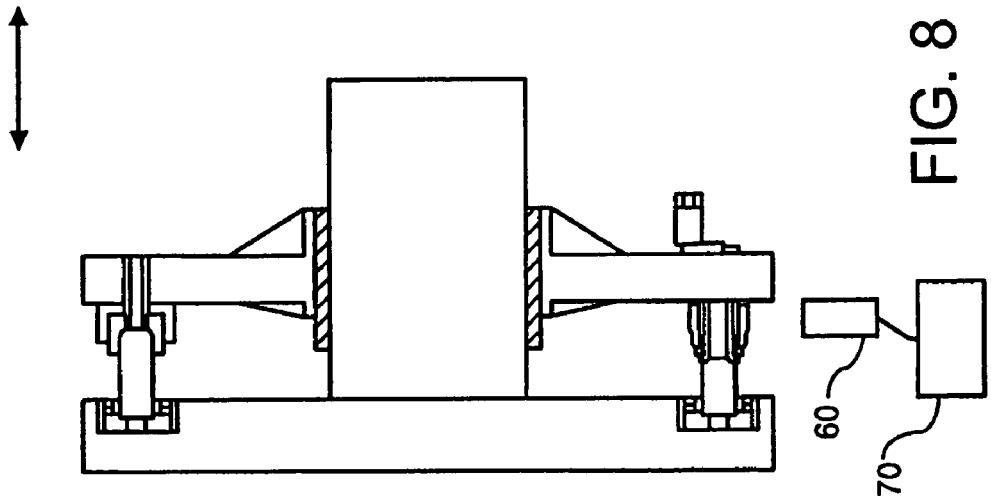
Figure 9:
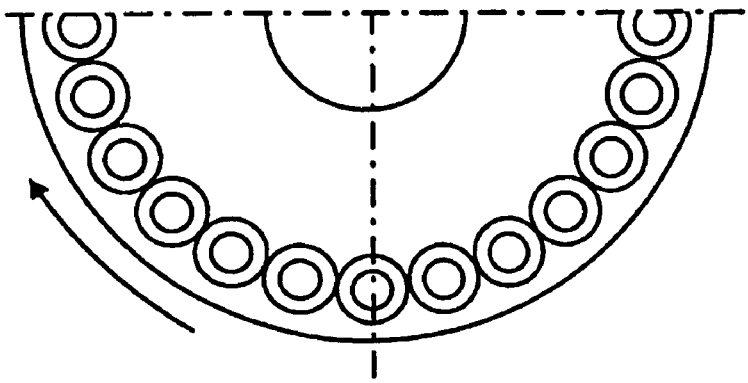

A vertically orientated forming table 6 faces the rotary table 3 and carries a series of deformation tools at spaced tooling stations 7. Following successive rotary index movements of rotary table 3, table 6 is advanced from a retracted position (FIG. 5) to an advanced position (FIG. 8). In moving to the advanced position the respective tools at tooling stations 7 perform forming operations on the container circumferential walls proximate their respective open ends 8. Successive tooling stations 7 perform successive degrees of deformation in the process. This process is well known and used in the prior art and is frequently known as necking. Necked designs of various neck/shoulder profiles such as that shown in FIG. 3 can be produced.

Necking apparatus typically operates at speeds of up to 200 containers per minute giving a typical working time duration at each forming station in the order of 0.3 seconds. In this time, it is required that the tooling table 6 moves axially to the advanced position, the tooling at a respective station contacts a respective container and deforms one stage in the necking process, and the tooling table 6 is retracted.

In accordance with the invention, in addition to the necking/shoulder-forming tooling at stations 7, the tooling table carries embossing toling 10 at an embossing station 9. The embossing tooling (shown most clearly in FIGS. 11 to 16) comprises inner forming tool parts 11*a*, 11*b* of respective arms 11 of an expandible internal tool mandrel 15. Tool parts 11*a*, 11*b* carry respective female embossing formations 12.

The embossing tooling 10 also includes a respective outer tool arrangement including respective arms 13 carrying tooling parts 13*a*, 13*b* having complementary male embossing formations 14. In moving to the table 7 advanced position the respective internal tool parts 11*a*, 11*b* are positioned internally of the container spaced adjacently the container 1 wall; the respective external tool parts 13*a*, 13*b* are positioned externally of the container spaced adjacently the container 1 wall.

Figures 11, 11A:
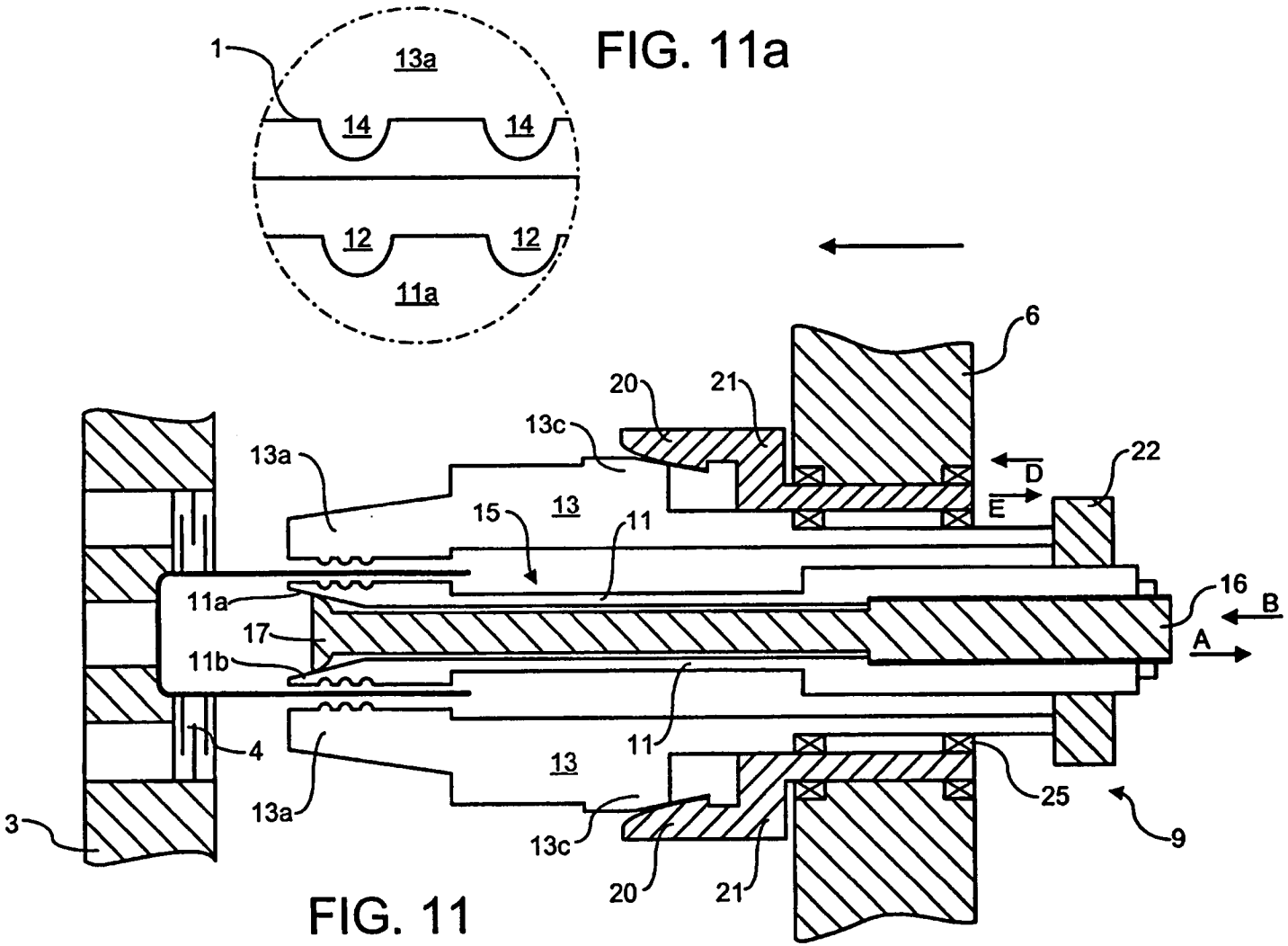
FIG. 11 is a schematic close up sectional view of the apparatus of the preceding figures in a first stage of the forming process.
FIG. 11*a* is a detail view of the forming tools and the container wall in the stage of operation of FIG. 11.

The internal mandrel 15 is expandible to move the tooling parts 11*a*, 11*b* to a relatively spaced apart position in which they abut the internal wall of the container 1 (see FIG. 12) from the collapsed position shown in FIG. 11 (tools 11*a*, 11*b* spaced from the internal wall of the container 1). An elongate actuator rod 16 is movable in a longitudinal direction to effect expansion and contraction of the mandrel 15 and consequent movement apart and toward one another of the tool parts 11*a*, 11*b*. A the cam head portion 17 of the, actuator rod 16 effects expansion of the mandrel 15 as the actuator rod 16 moves in the direction of arrow A. The cam head portion 17 acts against sloping wedge surfaces 65 of the tool parts 11*a*, 11*b* to cause expansion (moving apart) of the tool parts 11*a*, 11*b*. The resilience of arms 11 biases the mandrel 15 to the closed position as the rod 16 moves in the direction of arrow B.

Outer tool arms 13 are movable toward and away from one another under the influence of closing cam arms 20 of actuator 21 acting on a cam shoulder 13*c* of respective arms 13. Movement of actuator 21 in the direction of arrow D causes the external tooling parts 13*a* to be drawn toward one another. Movement of actuator 21 in the direction of arrow E causes the external tool parts 13*a* to relatively separate. Arms 13 and 11 of the outer tool arrangement and the inner mandrel are retained by cam support ring 22. The arms 11, 13 resiliently flex relative to the support ring 22 as the actuators 21, 16 operate.

As an alternative to the cam/wedge actuation arrangement, other actuators may be used such as hydraulic/pneumatic, electromagnetic (e.g. solenoid actuators) electrical (servo/stepping) motors.

The operation of the embossing tooling is such that the internal mandrel 15 is operable to expand and contract independently of the operation of the external tool parts 13*a*.

The internal mandrel 15 (comprising arms 11) and the external tooling (comprising arms 13) connected at cam support ring 22, are rotatable relative to table 6, in unison about the axis of mandrel 15. Bearings 25 are provided for this purpose. A servo-motor (or stepping motor) 26 is connected via appropriate gearing to effect controlled rotation of the tooling 10 relative to table 6 in a manner that will be explained in detail later.

Figure 12A:
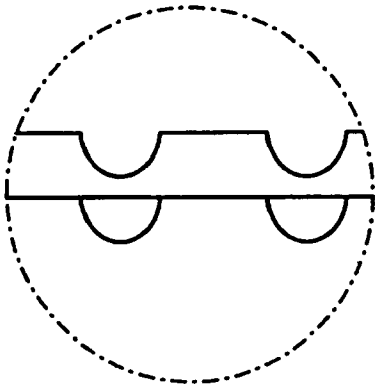
FIGS. 12, 12*a* to 16, 16*a* correspond to the views of FIGS. 11 and 11*a*.
Figure 12:
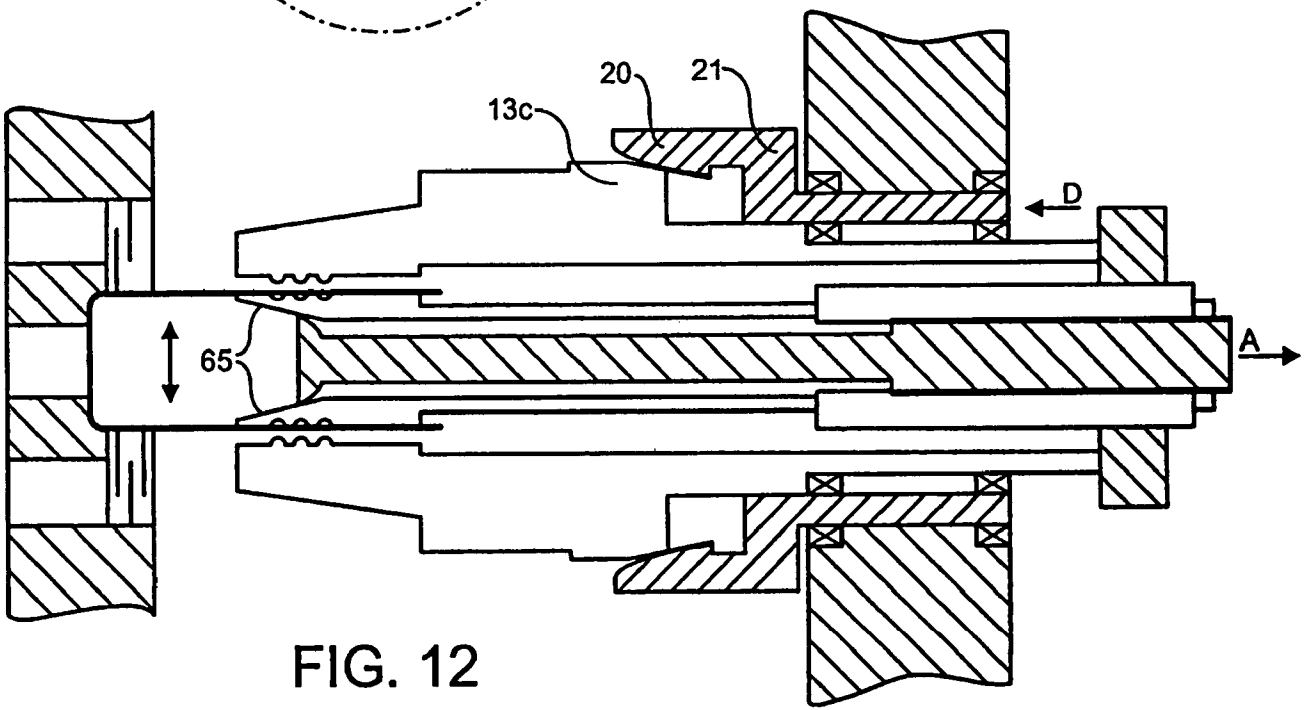

With the tooling 10 in the position shown in FIG. 11, the mandrel 15 is expanded by moving actuator rod 16 in the direction of arrow A causing the internal tooling parts 11*a* to lie against the internal circumferential wall of cylinder 1, adopting the configuration shown in FIGS. 12, 12*a*. Next actuator 21 moves in the direction of arrow D causing cam arms 20 to act on cam shoulder 13*c* and flexing arms 13 toward one another. In so doing the external tooling parts 13*a* engage the cylindrical wall of container 1, projections 14 deforming the material of the container 1 wall into respective complementary receiving formations 12 on the internal tooling parts 11*a*.

The deforming tooling parts 11*a*, 13*a*, can be hard, tool steel components or formed of other materials. In certain embodiments one or other of the tooling parts may comprise a conformable material such as plastics, polymeric material or the like.

Figure 13A:
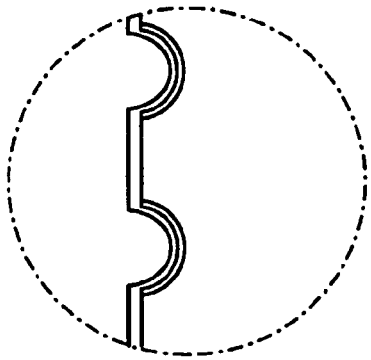
Figure 13:
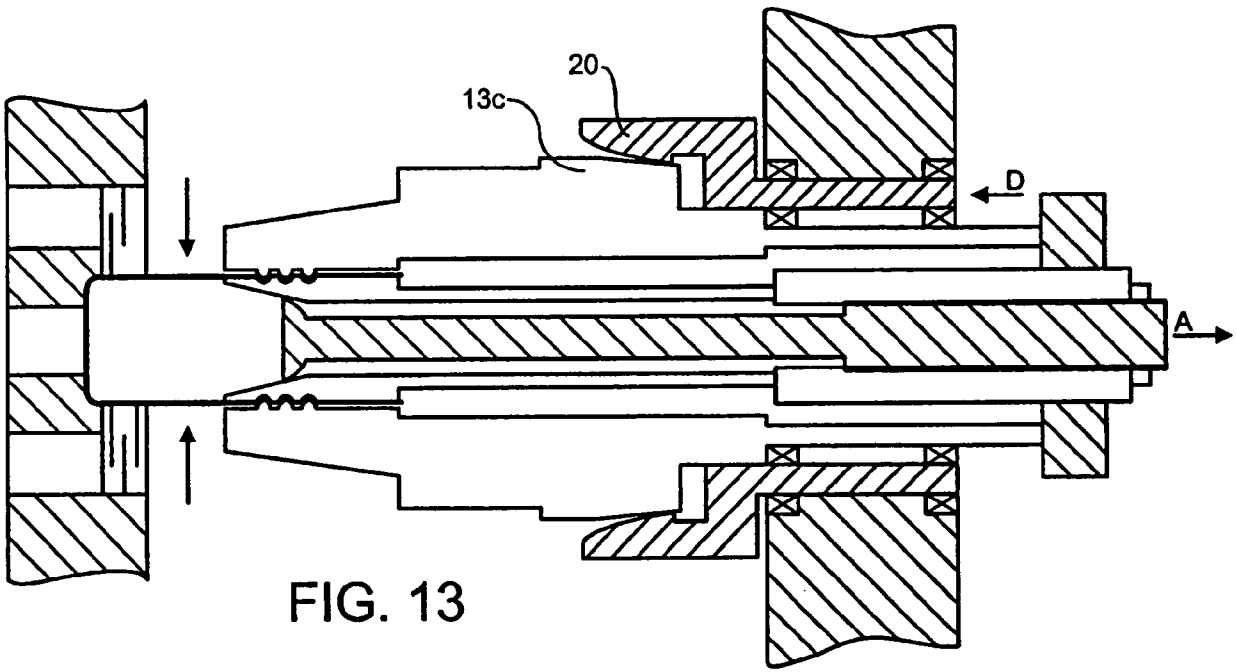

An important feature is that the internal tooling parts 11*a* support the non deforming parts of the container wall during deformation to form the embossed pattern 50. At this stage in the procedure, the situation is as shown in FIGS. 13, 13*a*. The configuration and arrangement of the cam arms 20, cam shoulders 13*c* of the external embossing tooling and the sloping (or wedge) cam surface of internal tooling parts 11*a* (cooperating with the cam head 17 of rod 16) provide that the embossing force characteristics of the arrangement can be controlled to ensure even embossing over the entire area of the embossed pattern SO. The external cam force action on the outer tool parts 13*a* is rearward of the embossing formations 14; the internal cam force action on the inner tool parts 11*a* is forward of the embossing formations 12. The forces balance out to provide a final embossed pattern of consistent depth formations over the entire zone of the embossed pattern 50.

Figure 14A:
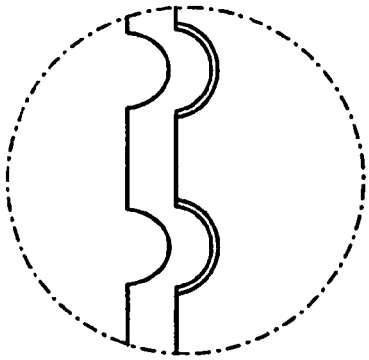
Figure 14:
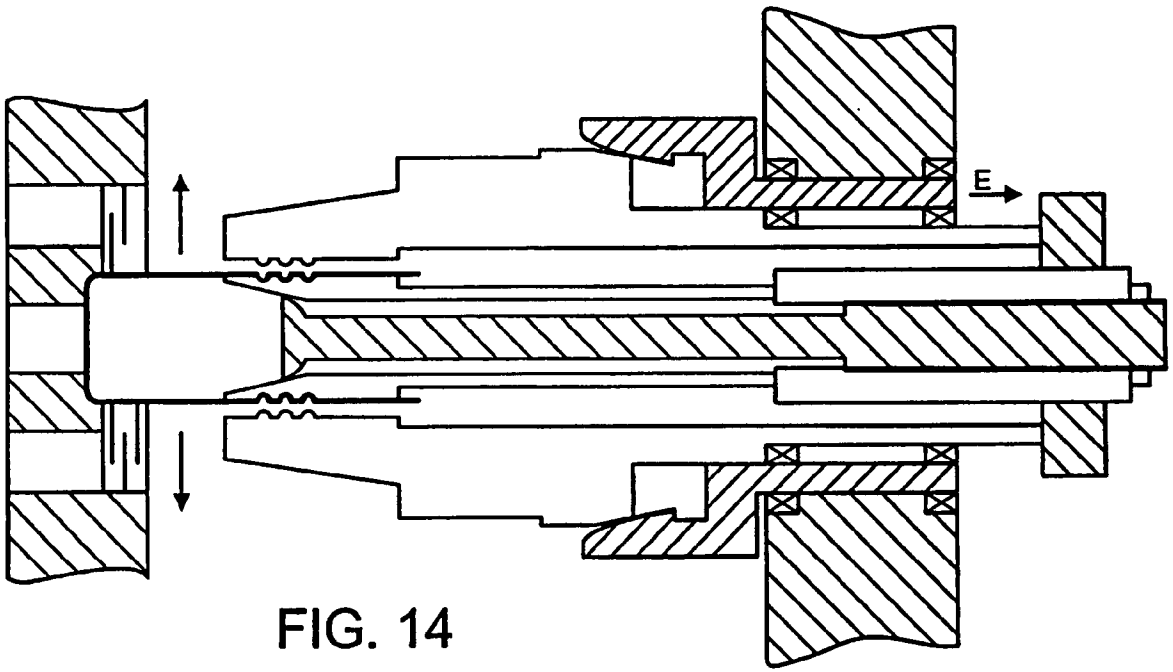

Next actuator 21 returns to its start position (arrow E) permitting the arms 13 of the external toling to flex outwardly to their normal position. In so doing tooling parts 13*a* disengage from embossing engagement with the container 1 external surface. At this stage in the procedure, the situation is as shown in FIGS. 14, 14*a*.

Figure 15A:
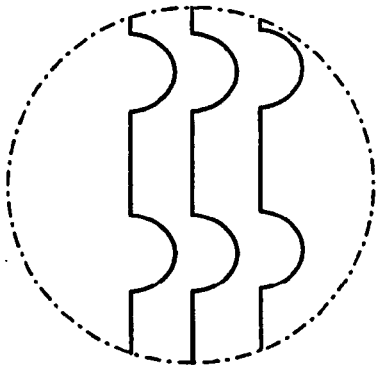
Figure 15:
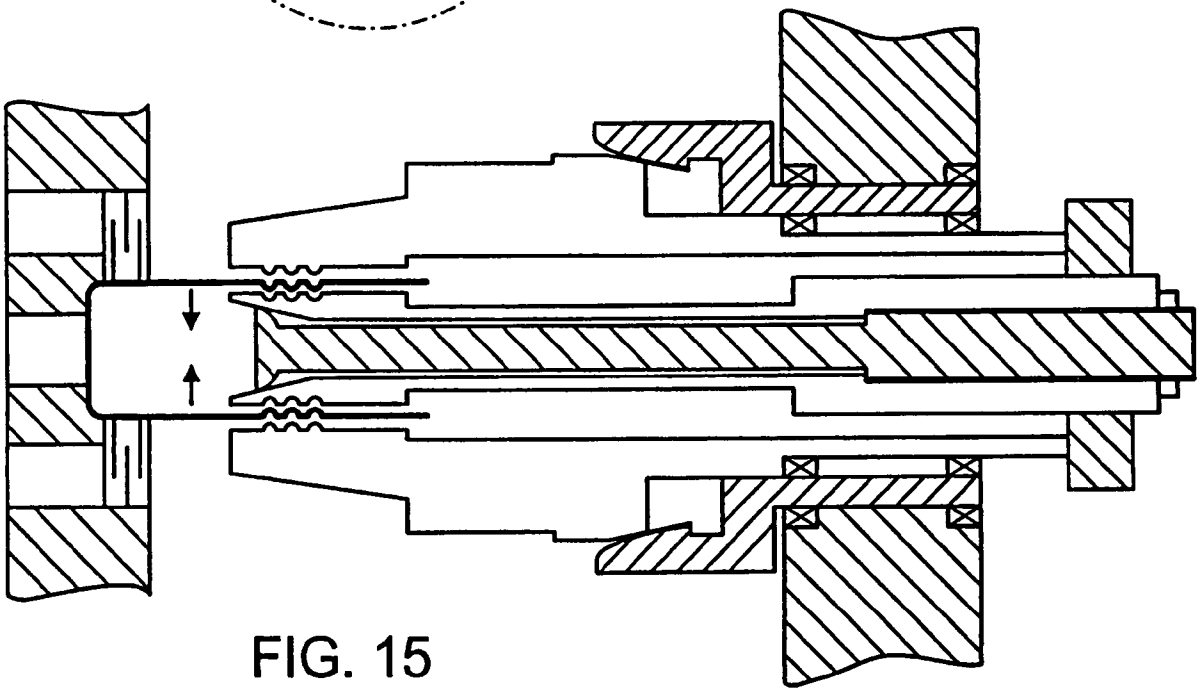

The next stage in the procedure is for the internal mandrel to collapse moving tooling parts 11*a* out of abutment with the internal wall of the cylinder 1. At this stage in the procedure, the situation is as shown in FIGS. 15, 15*a*.

Finally the tooling table 6 is retracted away from the rotatable table 3 withdrawing the tooling 10 from the container. At this stage in the procedure, the situation is as shown in FIGS. 16, 16*a*.

In the embodiment described, the movement of the tools to effect embossing is translational only. It is however feasible to utilise rotational external/internal embossing tooling as is known generally in the prior art.

The rotary table is then indexed rotationally moving the embossed container to adjacent with the next tooling station 7, and bringing a fresh container into alignment with the embossing tooling 10 at station 9.

The embossing stages described correspond to stages 106 to 112 in the flow diagram of FIG. 1.

Prior to the approachment of the embossing tooling 10 to a container 1 clamped at table 3 (FIG. 11 and stage 106 of FIG. 1) it is important that the container 1 and tooling 10 are accurately rotationally oriented to ensure that the embossed pattern 50 is accurately positioned with respect to the printed design on the exterior of the container.

According to the present invention this is conveniently achieved by reviewing the position of a respective container 1 whilst already securely clamped in a chuck 4 of the rotary table 3, and rotationally reorientating the embossing tooling 10 to the required position. This technique is particularly convenient and advantageous because a rotational drive of one arrangement (the embossing tooling 10) only is required. Chucks 4 can be fixed relative to the table 3 and receive containers in random axial rotational orientations. Moving parts for the apparatus are therefore minimised in number, and reliability of the apparatus is optimised.

Figure 4:
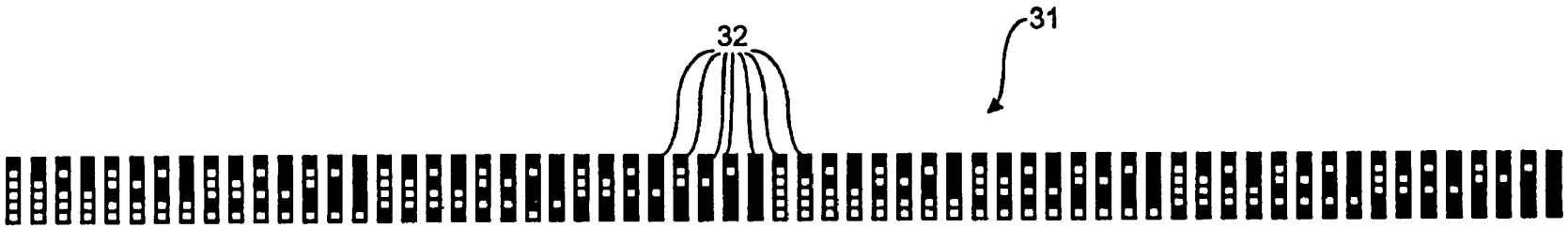
FIG. 4 is a 360 degree view of a positional code in accordance with the invention.

The open ends 8 of undeformed containers 1 approaching the apparatus 2 have margins 30 printed with a coded marking band 31 comprising a series of spaced code blocks or strings 32 (shown most clearly in FIG. 4). Each code block/string 32 comprises a column of six data point zones coloured dark or light according to a predetermined sequence.

With the container 1 clamped in random orientation in a respective chuck 4 a charge coupled device (CCD) camera 60 views a portion of the code in its field of view. The data corresponding to the viewed code is compared with the data stored in a memory (of controller 70) for the coded band and the position of the can relative to a datum position is ascertained. The degree of rotational realignment required for the embossing tooling 10 to conform to the datum for the respective container is stored in the memory of main apparatus controller 70. When the respective container 10 is indexed to face the embossing tooling 10 the controller instigates rotational repositioning of the tooling 10 to ensure that embossing occurs at the correct zone on the circumferential surface of the container 1. The controller 70 when assessing the angular position of the tooling relative to the angular position to be embossed on the container utilises a decision making routine to decide whether clockwise or counterclockwise rotation of the tooling 10 provides the shortest route to the datum position, and initiates the required sense of rotation of servo-motor 26 accordingly. This is an important feature of the system in enabling rotation of the tooling to be effected in a short enough time-frame to be accommodated within the indexing interval of the rotating table 3.

The coding block 32 system is in effect a binary code and provides that the CCD camera device can accurately and clearly read the code and determine the position of the container relative to the tooling 10 datum by viewing a small proportion of the code only (for example two adjacent blocks 32 can have a large number of unique coded configurations). The coding blocks 32 are made up of vertical data point strings (perpendicular to the direction of extent of the coding band 31) in each of which there are dark and light data point zones (squares). Each vertical block 32 contains six data point zones. This arrangement has benefits over a conventional bar code arrangement, particularly in an industrial environment where there may be variation in light intensity, mechanical vibrations and like.

As can be seen in FIG. 4, because the tooling 10 in the exemplary embodiment is arranged to emboss the same pattern at 180 degree spacing, the coding band 31 includes a coding block pattern that repeats over 180 degree spans.

The position determination system and control of rotation of the tooling 10 are represented in blocks 102 to 105 of the flow diagram of FIG. 1.

The coding band 31 can be conveniently printed contemporaneously with the printing of the design on the exterior of the container. Forming of the neck to produce, for example a valve seat 39 (FIG. 3) obscures the coding band from view in the finished product.

As an alternative to the optical, panoramic visual sensing of the coding band 31, a less preferred technique could be to use an alternative visual mark, or a physical mark (e.g. a deformation in the container wall) to be physically sensed.

Referring to FIG. 17, the technique is particularly switched to forming aesthetically pleasing embossed formations 50 of a greater height/depth dimension(d) (typically in the range 0.3 mm to 1.2 mm) than has been possible with prior art techniques. Additionally, this is possible with containers of greater wall thickness (t) than have been successfully embossed in the past. Prior art techniques have been successful in embossing aluminium material containers of wall thickness 0.075 mm to 0.15 mm. The present technique is capable of embossing aluminium containers of wall thickness above 0.15 mm, for example even in the range 0.25 mm to 0.8 mm. The technique is therefore capable of producing embossed containers for pressurised aerosol dispensed consumer products which has not been possible with prior art techniques. Embossed monobloc seamless aluminium material containers are particularly preferred for such pressurised aerosol dispensed products (typically having a delicate internal anti-corrosive coating or layer protecting the container material from the consumer product). The present invention enables such containers to be embossed (particularly registered embossed).

As an alternative to the technique described above in which the embossing tooling is rotated to conform to the datum situation, immediately prior to the container being placed in the chuck 4 and secured, the position of the container may be optically viewed to determine its orientation relative to the datum situation. If the orientation of the container 1 differs from the desired datum pre-set situation programmed into the system, then the container is rotated automatically about its longitudinal axis to bring the container 1 into the pre-set datum position. With the container in the required datum position, the container is inserted automatically into the clamp 4 of the holding station, and clamped securely. In this way the relative circumferential position of the printed design on the container wall, and the position of the tooling is coordinated. There is, thereafter, no requirement to adjust the relative position of the container and tooling. This technique is however less preferred than the technique primarily described herein in which the embossing tooling 10 is re-orientated.

The invention has primarily been described with respect to embossing aluminium containers of relatively thin wall thicknesses (typically substantially in the range 0.25 mm to 0.8 mm. It will however be readily apparent to those skilled in the art that the essence of the invention will be applicable to embossing thin walled containers/bodies of other material such as steel, steel tinplate, lacquered plasticised metallic container materials an other non-ferrous or non-metallic materials.

What is claimed is:

1. A method of deforming a thin walled body to coordinate with a pre-applied design on the wall of the body and in which one or more operations comprising necking of the body are carried out, the method comprising:

(i) holding the body securely in a clamp of a holding station of a multi-station holding table, the clamp being arranged to clamp the respective body non-rotatably;

(ii) advancing a multi-station tooling table relative to the holding table such that at a coordinated deformation station of the tooling table, an internal tooling part is inserted into the interior of the body and an external tooling part is positioned externally of the body whilst the body is clamped securely at the holding station; and, (iii) operating the tooling to engage with and deform the body at a predetermined wall zone, to coordinate with said pre-applied design on the wall of the body, whilst the body is clamped in a fixed orientation in the holding station;

wherein the tooling table and holding table are rotationally indexable relative to one another to bring a plurality of said bodies in succession to the coordinated deformation tooling station; the predetermined wall zone is co-aligned with the tooling by rotation of the body about an axis and then securing non-rotatably in the clamp at the holding station in said fixed orientation for the coordinated deformation of the wall of the body.

2. A method according to claim 1, wherein the body is optically viewed to determine its orientation relative to a datum and subsequently rotated about said axis to a datum orientation; with the body in the datum orientation, the body is inserted into the clamp of the holding station.

3. A method according to claim 1, wherein necking and coordinated deformation of the body is carried out at separate tooling stations of a respective tooling table.

4. A method according to claim 3, wherein necking and coordinated deformation is carried out with the body held at the same clamp, having been reorientated for coordinated deformation.

5. A method according to claim 1, wherein in addition to the coordinated deformation tooling, the tooling table carries necking and shoulder forming tooling.

6. Apparatus for deforming thin walled bodies, the apparatus comprising:

i) a multi-station holding table, respective holding stations comprising a respective clamp for clamping securely a respective one of said bodies non-rotatably in the respective clamp;

ii) a tooling table positioned at a location adjacent the holding table, the tooling table and holding table being rotationally indexable relative to one another to bring said bodies in succession to a coordinated deformation tooling station of the tooling table, and the tooling table being advanceable relative to the holding table; said coordinated deformation tooling station of the tooling table including an internal tooling part and an external tooling part arranged to engage within the interior, and on the exterior, of the body respectively, together to deform the body at a predetermined wall zone on the body to coordinate with a pre-applied design on the wall of the body, whilst the body is clamped securely in the clamp of the holding station;

iii) a determination arrangement for determining the orientation of the bodies relative to a reference datum situation;

iv) a reorientation arrangement for coordinated movement of the bodies about an axis of the respective bodies to accord with the datum situation.

7. Apparatus according to claim 6, including optical viewing means to determine the orientation of the bodies relative to the datum situation.

8. Apparatus according to claim 6, further comprising necking apparatus for performing a necking operation on the body.

9. Apparatus according to claim 6, wherein the tooling table includes a necking station to which the body is indexed.

10. A method of deforming a plurality of thin walled bodies to coordinate with a pre-applied design on the walls of the bodies and in which one or more operations comprising necking of the bodies are carried out, the method comprising:

(i) holding the bodies securely in corresponding clamps of a holding table, each clamp being non-rotatably fixed to the holding table and arranged to clamp the corresponding body in a fixed rotational orientation about its central axis;

(ii) providing a tooling table that is rotationally indexable relative to the holding table, the tooling table having a deformation station that includes an internal tooling part and an external tooling part;

(iii) for each particular body of the plurality of bodies, rotating the tooling table relative to the holding table to align the deformation station to the particular body, advancing the tooling table relative to the holding table such that the internal tooling part is inserted into the interior of the particular body and the external tooling part is positioned externally of the particular body whilst the respective body is clamped securely in its fixed rotational orientation at the holding table, and operating the internal and external tooling parts to engage with and deform the particular body at a predetermined wall zone to coordinate with the pre-applied design on the wall of the particular body, whilst the respective body is clamped in its fixed rotational orientation by the corresponding clamp of the holding table;

wherein the predetermined wall zone of each particular body is co-aligned with the internal and external tooling parts by rotating the particular body about its central axis and then using the corresponding clamp to secure the particular body in its fixed rotational orientation for subsequent deformation of the wall of the particular body.

11. A method according to claim 10, wherein the particular body is optically viewed to determine its orientation relative to a datum and subsequently rotated about said axis to a datum orientation; and with the particular body in the datum orientation, the particular body is inserted into the corresponding a clamp of the holding table.

12. A method according to claim 10, wherein necking operations are carried out at a tooling station different from said deformation station.

13. A method according to claim 12, wherein the necking operations carried out at the tooling station and the deformation operations carried out at the deformation station are performed with the respective bodies held in the same clamps.

14. A method according to claim 10, wherein the respective bodies are aligned to the reference datum situation by the operation of the determination arrangement and the reorientation arrangement prior to deformation by the deformation station.

15. A method according to claim 10, wherein the tooling table includes tooling that carries out necking and shoulder forming operations on the respective bodies.

16. Apparatus for deforming a plurality of thin walled bodies, the apparatus comprising:

i) a holding table comprising a plurality of holding stations corresponding to the plurality of bodies, each holding station having a clamp that is non-rotatably fixed to the holding table and arranged to clamp the corresponding body in a fixed rotational orientation about its central axis;

ii) a tooling table positioned at a location adjacent the holding table, the tooling table and holding table being rotationally indexable relative to one another to bring said plurality of bodies in succession to a deformation station of the tooling table, and the tooling table being advanceable relative to the holding table; said deformation station of the tooling table including an internal tooling part and an external tooling part arranged to engage within the interior, and on the exterior, of the respective body to deform the respective body at a predetermined wall zone on the respective body to coordinate with the pre-applied design on the wall of the particular body, whilst the respective body is clamped securely in a fixed rotational orientation in the corresponding clamp of the holding table;

iii) a determination arrangement for determining the orientation of the bodies relative to a reference datum situation; and iv) a reorientation arrangement for coordinated rotational movement of the bodies about their respective central axes to align with the datum situation.

17. Apparatus according to claim 16, including optical viewing means to determine the rotational orientation of the bodies relative to the datum situation.

18. Apparatus according to claim 16, wherein the tooling table includes tooling that performs necking operations on the respective bodies.

19. Apparatus according to claim 16, wherein the tooling table includes a necking station to which the respective bodies are indexed.

* * * * *